United States Patent [19]

Harvey

[11] 4,437,037

[45] Mar. 13, 1984

[54] DISPLAY PANEL AND KEEP-ALIVE ARRANGEMENT THEREFOR

[75] Inventor: Edgar L. Harvey, Jamesburg, N.J.

[73] Assignee: Burroughs Corporation, Detroit, Mich.

[21] Appl. No.: 335,755

[22] Filed: Dec. 30, 1981

[51] Int. Cl.[3] ..... H01J 17/49; H01J 17/46

[52] U.S. Cl. ..... 313/585; 313/601

[58] Field of Search ..... 313/188, 217, 220, 197, 313/198, 581–585, 601, 604, 631, 634

[56] References Cited

U.S. PATENT DOCUMENTS

| | | | |
|---|---|---|---|
| 3,631,530 | 12/1971 | Ogle | 313/220 |
| 3,699,376 | 10/1972 | Caras | 313/585 |
| 4,010,395 | 3/1977 | Holz | 313/585 |
| 4,210,838 | 7/1980 | Walters | 313/584 X |

*Primary Examiner*—Palmer C. Demeo
*Assistant Examiner*—Sandra L. O'Shea
*Attorney, Agent, or Firm*—Kevin R. Petersen; Robert A. Green; David G. Rasmussen

[57] ABSTRACT

A display panel comprises a gas-filled envelope made up of a base plate and a face plate sealed together hermetically. The base plate is provided with a plurality of parallel, longitudinal slots, and an anode wire is disposed in each of the slots in the base plate. An array of identical metal strip electrodes are provided on the base plate at an angle to the anode wires to define operative gas cells therewith. The first strip electrode is operated as a keep-alive anode with respect to two auxiliary electrodes seated in slots in the base plate, the second strip electrode is operated as a reset cathode, and the other strip electrodes are operated as the scan/display cathodes for the panel.

2 Claims, 2 Drawing Figures

DISPLAY PANEL AND KEEP-ALIVE ARRANGEMENT THEREFOR

BACKGROUND OF THE INVENTION

One type of display panel which has been made and sold commercially is known as a SELF-SCAN panel and is described in many patents including U.S. Pat. No. 3,989,981, dated Nov. 2, 1976, of James A. Ogle and George E. Holz. A version of this type of panel, known as a SELF-SCAN I panel, includes two layers of cells, a lower layer of scanning cells, and an upper layer of display cells, with each display cell in operative relation with a scanning cell. Another version of this general type of panel has the scan cells and display cells coplanar, and is known as a single layer panel, or as a SELF-SCAN II panel. This panel is described in U.S. Pat. No. 4,099,098, dated July 4, 1978, of Rudolph A. Cola. Another single layer panel is shown in U.S. Pat. No. 3,631,530, dated Dec. 28, 1971, of James A. Ogle, and the present invention represents an improvement in the keep-alive mechanism for the panel described in the latter patent.

DESCRIPTION OF THE INVENTION

Figure 1:
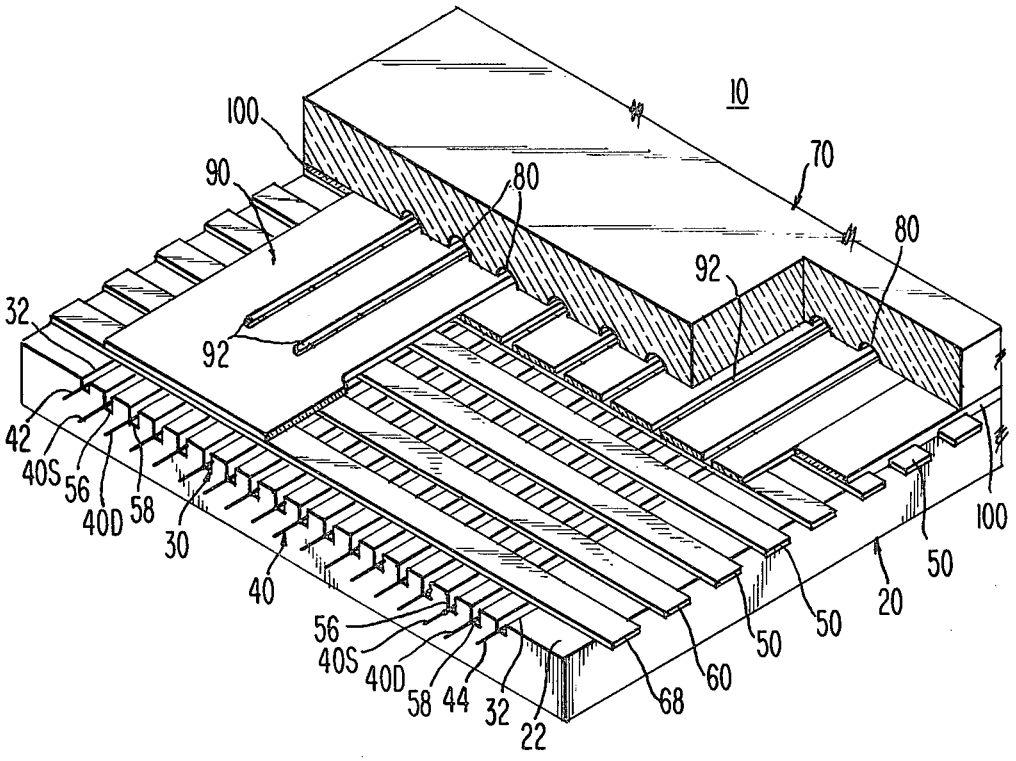
FIG. 1 is a perspective exploded view of a display panel embodying the invention.
Figure 2:
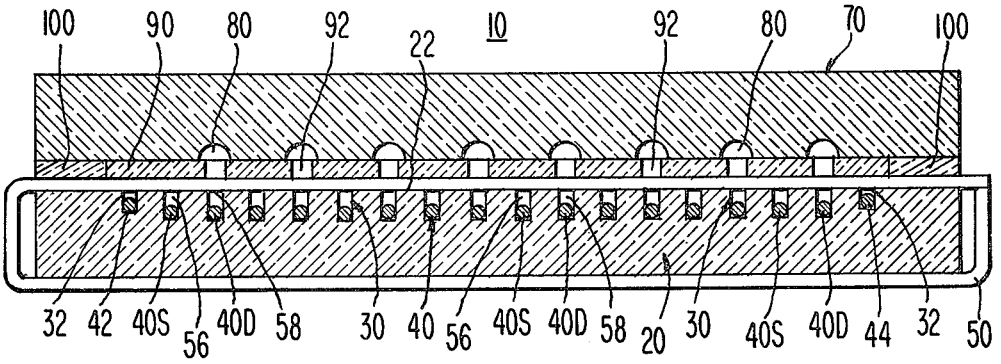
FIG. 2 is a sectional view of the panel of FIG. 1 shown assembled.

A SELF-SCAN display panel 10 embodying the invention includes a glass base plate 20 having a plurality of parallel longitudinal slots 30 which extend partially into the top surface 22 thereof but across the length thereof. Anode electrodes 40S and 40D, which may be in the form of wires, are seated in the slots 30, with the anodes 40S and 40D alternating with each other. Anodes 40S are scan anodes, and anodes 40D are display anodes. The anodes may be formed by a wire winding operation.

Cathode electrodes 50, in the form of narrow strips, are disposed on the top surface of the base plate oriented at right angles to the anodes 40. The locations at which each cathode 50 crosses an anode 40 defines a column of cells; where each scan anode 40S is crossed by a cathode is a scan cell 56, and where each display anode 40D is crossed by a cathode is a display cell 58. In each column, the scan cells alternate with the display cells, and the scan cells are aligned in rows, and the display cells are aligned in rows.

A SELF-SCAN panel also includes a reset cathode electrode 60 adjacent to the first cathode 50 in the array of cathodes 50. The reset cathode forms a column of reset cells with the anodes 40.

According to the invention, a keep-alive arrangement is provided which comprises a strip electrode 68 on the top surface of base plate 20 adjacent to the reset cathode 58, and two electrodes 42 and 44 seated in slots 32 in the top surface of base plate 20. The slots 32 and the electrodes 42 and 44 are disposed adjacent to the upper and lower margins of the base plate adjacent to the uppermost and lowermost anodes 40. The slots 32 and electrodes 42 and 44 are of only sufficient length to permit electrodes 42 and 44 to lie under and in operative relation with strip electrode 68 with which they provide the desired keep-alive action. The electrodes 50, 60, and 68 are preferably mechanically identical, and they may be formed by a winding operation.

The panel 10 includes a glass face plate 70 having an inner surface which is chemically etched to provide a plurality of parallel shallow slots or depressions 80 having a depth of about 3 to 4 mils. The slots 80 are disposed transverse to the cathodes 50 and overlie each slot in which a display anode is seated and each row of display cells. This inner surface of the face plate 70 is coated with a thin layer 90 of black insulating material to provide light contrast. This layer is about one mil thick, and it covers the entire inner surface of the face plate, but not the depressions 80. In this area, the layer 90 has display slots 92 which are aligned with the slots 80 in the face plate. These slots 92 in coating 90 are also aligned with the rows of display cells. The rest of the layer 90 overlies the scan cells and blocks them from being seen through the face plate 70. The face plate 70 is hermetically sealed to the base plate and is seated on the cathodes 50, 60 and electrode 68 by means of a thin glass frit sealing ring 100 which is disposed between the base plate and face plate along their aligned perimeters.

The panel is filled with an ionizable gas such as neon with a small portion of xenon, as is well known in the art of SELF-SCAN panels.

The above-identified patents describe the operation of two-layer (SELF-SCAN I) panels and single-layer (SELF-SCAN II) panels, and panel 10 is operated in the same way as other SELF-SCAN panels (but more like the above-identified Ogle patent) in that the columns of scan cells are turned on sequentially and then information signals are applied to selected display anodes to cause glow to transfer from the thus selected scan cell to the adjacent display cell where display glow appears. This operation is carried out continually and sequentially throughout the columns of cells of the panel to provide in the display cells an apparently stationary but changeable message.

Considering the operation of panel 10 somewhat more specifically, operating potentials are applied to keep-alive electrodes 68 and 42, 44 so that electrode 68 is an anode and electrodes 42 and 44 operate as glow cathodes and generate excited particles. Positive potential is applied to all of the scan anodes 40S, and more negative potential is applied to the reset cathode 60, and this, with the keep-alive particles, causes the turn-on of the column of reset cells formed by the crossing of reset cathode 60 and the scan anodes 40S. This is the beginning of a scanning cycle.

The scanning cycle then is carried out by the application of negative cathode operating potential to each of the cathodes 50 in turn, beginning with the cathodes adjacent to the reset cathode 60. This turns on all of the scan cells in each column of cells sequentially. With all scan cells in a column turned on, there is cathode scan glow on the lower surface of the energized cathode 50 above all of the scan anodes 40S. This scan glow is not visible to a viewer either because it is at the lower surface of each cathode, or, if it moves to the upper surface, it is not visible because of black coating 90. As the columns of scan cells are thus turned on sequentially, information signals of sufficient magnitude are applied to selected display anodes 40D, and this causes glow to transfer from a scan slot 30 to a display slot 30 across the land between them to the portion of the top surface of the cathode overlying the selected display anode(s) 40D. This glow is visible to a viewer because it is aligned wih slots 92 and 80. As the scanning operation is carried out through the panel and selected display cells are caused to glow, an apparently stationary but changeable message is visible in the energized display cells.

The keep-alive arrangement of the invention has the advantage that the presence of the keep-alive anode 68 close to the reset cathode 60 facilitates the turn-on of the reset cells. In addition, since electrodes 68, 60 and 50 may be identical and may be set in place by a winding operation, it is clear that an economical structure is provided.

What is claimed is:

1. A display panel comprising a gas-filled envelope made up of a base plate and a face plate sealed together hermetically, an array of rows and columns of gas-filled cells, a plurality of first electrodes disposed parallel to each other and seated in elongated first slots in the top surface of said base plate, a plurality of second electrodes seated in other slots in the top surface of said base plate, and a plurality of identical strip electrodes disposed between said base plate and face plate and oriented at an angle to said first electrodes to define gas cells therewith, one of said strip electrodes being operable as an anode with respect to said second electrodes operable as glow cathodes, and the others of said strip electrodes being operable as glow cathodes with respect to said first electrodes, said strip electrodes being disposed in an array along said base plate, and said one of said strip electrodes is the first strip electrode in the array, said other slots being shorter than said first slots and extending from the edge of the base plate only up to said first strip electrode.

2. The panel defined in claim 1 wherein said first slots are disposed in an array, and said other slots are placed adjacent to the upper and lower margins of said array of first slots.

* * * * *